US008044900B2

(12) United States Patent
Kim et al.

(10) Patent No.: US 8,044,900 B2
(45) Date of Patent: Oct. 25, 2011

(54) LIQUID CRYSTAL DISPLAY DEVICE FOR COMPENSATING A COMMON VOLTAGE AND THE METHOD OF DRIVING THE SAME

(75) Inventors: Do Young Kim, Daegoo (KR); Eun Kyeong Kang, Gyeongbuk (KR)

(73) Assignee: LG Display Co., Ltd., Seoul (KR)

( * ) Notice: Subject to any disclaimer, the term of this patent is extended or adjusted under 35 U.S.C. 154(b) by 877 days.

(21) Appl. No.: 11/318,643

(22) Filed: Dec. 28, 2005

(65) Prior Publication Data

US 2007/0002005 A1 Jan. 4, 2007

(30) Foreign Application Priority Data

Jun. 29, 2005 (KR) ..... 10-2005-0057042

(51) Int. Cl.
*G09G 3/36* (2006.01)

(52) U.S. Cl. ..... 345/87; 345/103

(58) Field of Classification Search ..... 345/87, 345/94, 98, 100, 103, 204, 211
See application file for complete search history.

(56) References Cited

U.S. PATENT DOCUMENTS

| | | | | |
|---|---|---|---|---|
| 5,831,605 | A * | 11/1998 | Yasui et al. | 345/211 |
| 5,841,410 | A * | 11/1998 | Oda et al. | 345/58 |
| 7,403,198 | B2 * | 7/2008 | Lin | 345/211 |
| 2002/0196220 | A1 * | 12/2002 | Sato et al. | 345/87 |
| 2004/0164943 | A1 * | 8/2004 | Ogawa et al. | 345/92 |
| 2005/0253836 | A1 * | 11/2005 | Kim et al. | 345/212 |

* cited by examiner

*Primary Examiner* — Chanh Nguyen
*Assistant Examiner* — Ram Mistry
(74) *Attorney, Agent, or Firm* — Morgan, Lewis & Bockius LLP

(57) ABSTRACT

A liquid crystal display device (LCD) includes a liquid crystal panel having a plurality of gate lines, a plurality of data lines, and a plurality of common voltage supply lines, the liquid crystal panel being divided into a plurality of blocks, a plurality of gate driver integrated circuits (ICs) connected to the plurality of gate lines, a plurality of data driver ICs connected to the plurality of data lines, and a plurality of common voltage compensators to supply compensated common voltages to the common voltage supply lines the corresponding blocks.

12 Claims, 3 Drawing Sheets

LIQUID CRYSTAL DISPLAY DEVICE FOR COMPENSATING A COMMON VOLTAGE AND THE METHOD OF DRIVING THE SAME

This application claims the benefit of the Korean Patent Application No. 2005-057042 filed on Jun. 29, 2005, which is hereby incorporated by reference.

BACKGROUND OF THE INVENTION

1. Field of the Invention

The present invention relates to a liquid crystal display device, and more particularly, to a liquid crystal display device capable of minimizing a distortion of a common voltage and a method of driving the same.

2. Discussion of the Related Art

Liquid crystal display devices (LCDs) display an image by controlling a light transmittance of liquid crystal cells in accordance with video signals. An active matrix type LCD having thin film transistors (TFTs) at each liquid crystal cell is suited for displaying moving images.

FIG. 1 is a plan view of a related art LCD. As illustrated in FIG. 1, the related art LCD includes a liquid crystal panel 2, a plurality of data tape carrier packages (TCPs) 4 connected between the liquid crystal panel 2 and a data printed circuit board (PCB) 8, a plurality of data driver integrated circuits (ICs) 6 mounted on each of data TCPs, a timing controller 16 built in the data PCB 8, a plurality of gate TCPs 10 connected to another side of the liquid crystal panel 2, and a plurality of gate driver ICs 12 integrated in each of the gate TCPs 10.

A pixel region of the liquid crystal panel 2 is defined at each intersection of a plurality of gate lines GL0 to GLn and a plurality of data lines DL1 to DLm. The TFTs and pixel electrodes are formed on the pixel regions. A display region 17 is defined by the plurality of pixel regions, and a non-display region 19 is defined by regions outside the display region 17. A data pad (not shown) connected to the data TCP 4 and a data link (not shown) for connecting the data pad with the corresponding data line are disposed in an outer region of the display region 17, namely, the non-display region 19. Additionally, a gate pad (not shown) connected to the gate TCP 10 and a gate link (not shown) for connecting the gate pad with the corresponding gate line are disposed in the non-display region 19. Common voltage (Vcom) supply lines 13 are disposed in parallel to the respective gate lines GL0 to GLn on the display region 17.

The liquid crystal panel 2 includes a lower substrate 1 and an upper substrate 3 each having a transparent insulating substrate, and liquid crystal (not shown) injected between the lower substrate 1 and the upper substrate 3. A LOG-type signal line group 14 is formed on the lower substrate 1 to connect in series a gate driver IC 12 mounted on the gate TCP 10 to a data TCP 4 in the non-display region 19. More specifically, the LOG-type signal line group 14 is disposed between a first data TCP 4 and a first gate TCP 10 to supply gate control signals and gate voltages supplied from an external source to the first gate TCP 10 through the data PCB 8 and the first data TCP 4.

Each of the gate driver ICs 12 supplies a gate high voltage VGH to the corresponding gate lines GL1 to GLn sequentially in response to a gate control signal supplied from the timing controller 16. Each of the data driver ICs 6 supplies a data voltage of corresponding data lines DL1 to DLm at each horizontal period H1 to Hm in response to a data control signal from the timing controller 16. The timing controller 16 generates the gate control signal controlling the gate driver ICs 12 and the data control signal controlling the data driver ICs 6.

A common voltage generator 18 generates a common voltage Vcom to drive the liquid crystal panel 2 using a power voltage Vdd generated from a DC/DC converter (not shown). The common voltage Vcom is supplied to the common voltage supply lines 13 on the liquid crystal panel 2. The common voltage supply lines 13 and gate lines GL0 to GLn are formed on the same layer, and then a gate insulating layer is formed over the lines. The data lines DL1 to DLm are then formed on the gate insulating layer. As a result, a capacitance is formed between the common voltage supply lines 13 and the data lines DL1 to DLm due to the presence of the gate insulating layer between the common voltage supply lines 13 and the data lines DL1 to DLm.

Accordingly, when a data signal value between the data lines DL1 to DLm changes drastically, a ripple is generated in the common voltage Vcom that is supplied to the common voltage supply lines 13 by the capacitance. A crosstalk phenomenon is generated on the liquid crystal panel 2 due to the common voltage Vcom distorted by the ripple. Therefore, a common voltage Vcom compensator 20 is configured to prevent this crosstalk phenomenon.

The common voltage Vcom compensator 20 compensates the distorted common voltage and supplies a compensated common voltage to the liquid crystal panel 2 in the following manner. When the common voltage Vcom is supplied to the liquid crystal panel 2 during one frame, the common voltage Vcom becomes distorted by the capacitance between the common voltage supply line 13 and the data lines DL1 to DLm, thereby causing a ripple in the common voltage Vcom. During the next frame, the common voltage Vcom compensator 20 receives the distorted common voltage in a feedback loop on the liquid crystal panel 2, compensates the distorted common voltage, and supplies the compensated common voltage to the liquid crystal panel 2.

However, the amount of distortion of the common voltage Vcom generated is different in the top, middle, and bottom sections of the liquid crystal panel 2 due to load characteristics of the liquid crystal panel 2. That is, the degree of distortion of the common voltage Vcom in the top, middle, and bottom sections of the liquid crystal panel 2 changes as the size of the liquid crystal panel 2 or the line resistance of the common voltage supply lines 13 increases. Therefore, the distortion of the common voltage Vcom cannot be reduced in all sections of the liquid crystal panel 2 (i.e., the top, middle, and bottom sections of liquid crystal panel 2). Accordingly, although the related art LCD partially compensates for the distortion of the common voltage Vcom supplied to the liquid crystal panel 2, the distortion of the common voltage Vcom cannot be compensated for the entire region of the liquid crystal panel 2. Consequently, the image quality of the related art LCD suffers.

SUMMARY OF THE INVENTION

Accordingly, the present invention is directed to a liquid crystal display device and a method of driving the same that substantially obviate one or more problems due to limitations and disadvantages of the related art.

An object of the present invention is to provide a liquid crystal device and a method of driving the same for improving an image by compensating a distortion of a common voltage in each region of a liquid crystal panel.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device (LCD) includes a liquid crystal panel having a plurality of gate lines, a plurality of data lines, and a plurality of common voltage supply lines, the liquid crystal panel being divided into a plurality of blocks, a plurality of gate driver integrated circuits (ICs) connected to the plurality of gate lines, a plurality of data driver ICs connected to the plurality of data lines, and a plurality of common voltage compensators to supply compensated common voltages to the common voltage supply lines the corresponding blocks.

In another aspect, a liquid crystal display device (LCD) includes a liquid crystal panel having a plurality of gate lines and a plurality of data lines, the liquid crystal panel being divided into a plurality of blocks, a plurality of gate driver integrated circuits (ICs) connected to the plurality of gate lines, a plurality of data driver ICs connected to the plurality of data lines, and a plurality of common voltage compensators built into respective ones of the gate driver ICs to supply different compensation common voltages to the corresponding blocks.

In yet another aspect, a liquid crystal display device (LCD) includes a liquid crystal panel having a plurality of gate lines and a plurality of data lines, the liquid crystal panel being divided into a plurality of blocks, a plurality of gate driver integrated circuits (ICs) connected to the plurality of gate lines, a plurality of data driver ICs connected to the plurality of data lines, and a plurality of common voltage compensators built into respective ones of the data driver ICs to supply different compensation common voltages to the corresponding blocks.

In still yet another aspect, a method of driving a liquid crystal display device (LCD) including a liquid crystal panel having a plurality of gate lines and a plurality of data lines, the liquid crystal panel being divided into a plurality of blocks, a plurality of gate driver integrated circuits (ICs) connected to the plurality of gate lines, a plurality of data driver ICs connected to the plurality of data lines, a plurality of common voltage compensators supplying compensated common voltages to the corresponding blocks, and a common voltage generator for generating a predetermined common voltage to be supplied to the common voltage compensators, the method includes supplying the predetermined common voltage to each of the blocks in the liquid crystal panel through the corresponding common voltage compensator associated with each block, receiving a distorted common voltage generated in each of the blocks through the corresponding common voltage compensator associated with each block, and supplying a compensated common voltage to each of the blocks through the corresponding common voltage compensators associated with each block based on the received distorted common voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
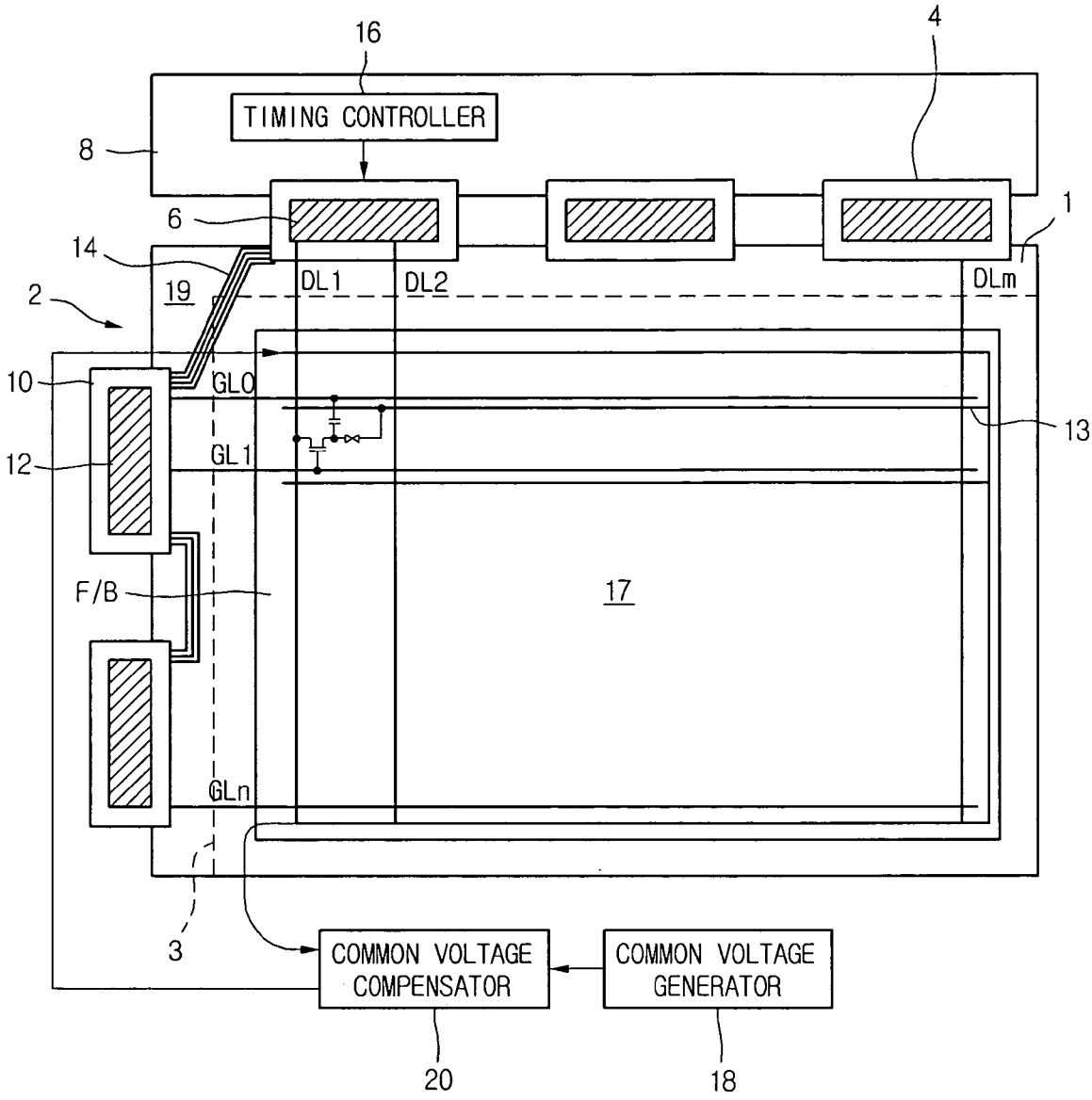
Fig.1 (Related Art)
FIG. 1 is a plan view of a related art liquid crystal display device (LCD)
Figure 2:
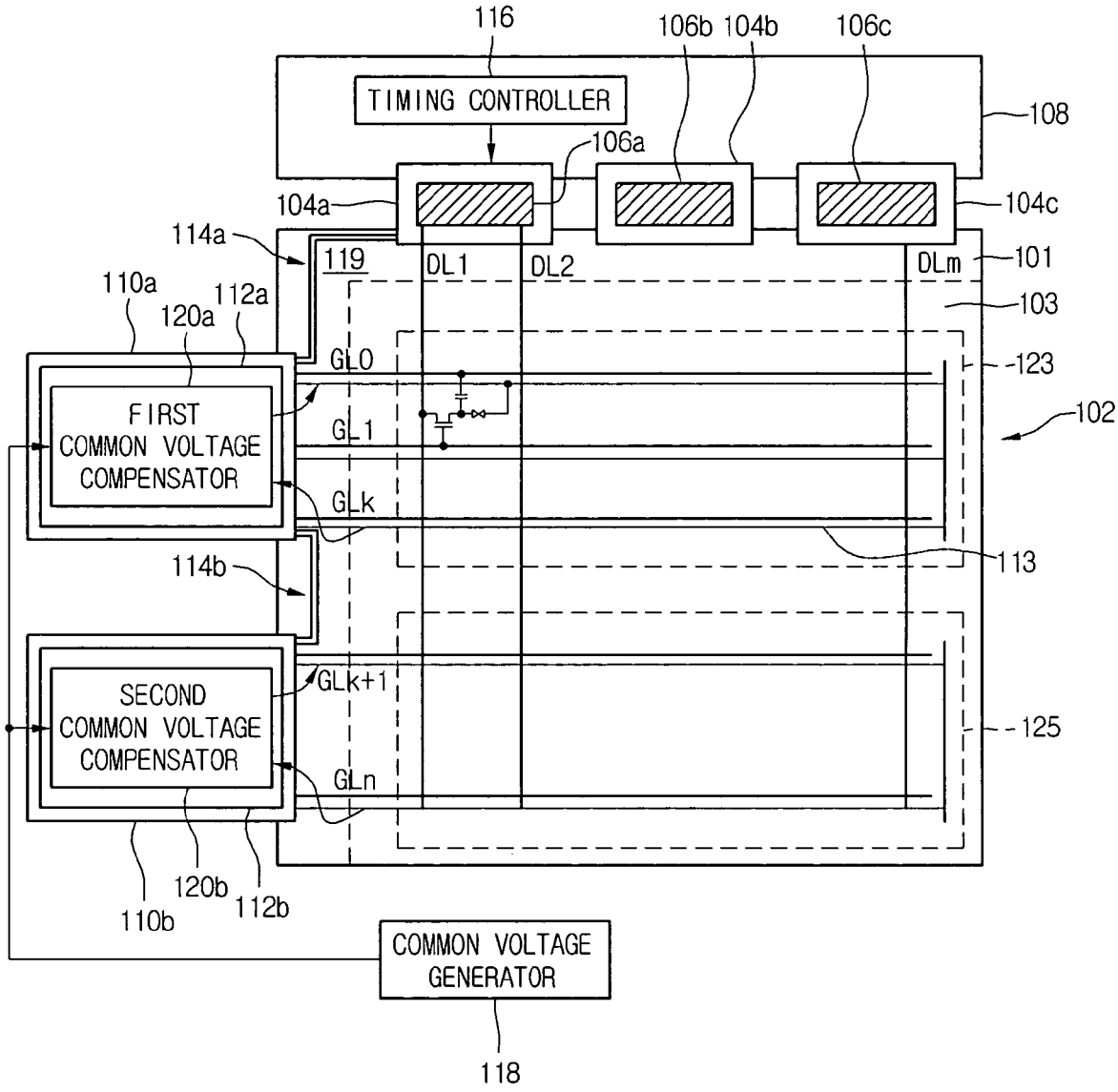
FIG. 2 is a plan view of an LCD according to an exemplary embodiment of the present invention.

As illustrated in FIG. 2, a liquid crystal display device (LCD) according to an exemplary embodiment of the present invention includes a liquid crystal panel 102, a plurality of data tape carrier packages (TCPs) 104*a*, 104*b*, and 104*c* connected between the liquid crystal panel 102 and a data printed circuit board (PCB) 108, data driver integrated circuits (ICs) 106*a*, 106*b*, and 106*c* mounted on each of the data TCPs 104*a*, 104*b*, and 104*c*, respectively, a timing controller 116 built in the data PCB 108, a plurality of gate TCPs 110*a* and 10*b* connected to another side of the liquid crystal panel 102, and gate driver ICs 112*a* and 112*b* mounted on each of the gate TCPs 110*a* and 110*b*, respectively. A pixel region of the liquid crystal panel 102 is defined at each intersection of a plurality of gate lines GL0 to GLn and a plurality of data lines DL1 to DLm. Thin film transistors (TFTs) and pixel electrodes are formed on each of the pixel regions. A display region is defined by a plurality of pixel regions. Accordingly, a non-display region is defined by a region outside the display region.

A data pad (not shown) connected to the data TCPs 104*a*, 104*b*, and 104*c* and a data link (not shown) connecting the data pad with the corresponding data line DL1 to DLm are disposed on an outer region of the display region, namely, the non-display region 119. Additionally, a gate pad (not shown) connected to the gate TCPs 10*a* and 110*b* and a gate link (not shown) connecting the gate pad with the corresponding gate line GL0 to GLn are also disposed on the non-display region 119. Common voltage Vcom supply lines 113 are disposed in parallel to the corresponding gate lines GL0 to GLn in the display region.

The liquid crystal panel 102 includes a lower substrate 101 and an upper substrate 103 each having a transparent insulating substrate, and liquid crystal (not shown) injected between the lower substrate 101 and the upper substrate 103. LOG-type signal line groups 114*a* and 114*b* for transmitting gate drive signals supplied to the gate driver ICs 112*a* and 112*b* are disposed on the non-display region 119 of the lower substrate 101.

The LOG-type signal line group 114 is formed between the data TCPs 104*a*, 104*b* and 104*c* and the gate TCPs 110*a* and 110*b*, and is disposed on the lower substrate 101 between the gate TCPs 110*a* and 110*b*. The data TCPs 104*a*, 104*b*, and 104*c* are electrically connected between the data PCB 108 and the liquid crystal panel 102. The data driver ICs 106*a*, 106*b*, and 106*c* are mounted on the data TCPs 104*a*, 104*b*, and 104*c*, respectively. Each of the data driver ICs 106*a*, 106*b*, and 106*c* is electrically connected to the plurality of the data lines DL1 to DLm.

The LOG-type signal line group 114*a* is connected to a first data TCP 104*a* among the plurality of data TCPs 104*a*, 104*b*, and 104*c*. Accordingly, a signal or a voltage generated from the timing controller 116 mounted on the data PCB 108 is supplied to the gate TCP 10*a* through the first data TCP 104*a* and the LOG-type signal line 114*a*. The gate TCPs 110*a* and 110*b* are connected to each other by the LOG-type signal line group 114*b*. That is, the first gate TCP 110*a* is driven by a signal supplied through the first data TCP 104*a* and the LOG-type signal line group 114*a*. Additionally, the second gate TCP 10*b* is driven by an output of the first gate TCP 110*a*. When there are additional gate TCPs, each additional gate TCP is driven by the output of the preceding gate TCP using the same operations. Accordingly, each of the gate TCPs 110*a* and 110*b* (and any additional gate TCPs) is driven sequentially by signals supplied from the first data TCP 104*a*.

Each of the gate TCPs 110*a* and 110*b* includes corresponding gate driver ICs 112*a* and 112*b*. That is, a first gate TCP 110*a* includes a first gate driver IC 112*a*, and a second gate TCP 10*b* includes a second gate driver IC 112*b*. Each of the gate driver ICs 112*a* and 112*b* is electrically connected to a plurality of gate lines GL0 to GLn. For purposes of example, an area occupied by a plurality of gate lines connected to the gate driver ICs 112*a* and 112*b* is defined as blocks 123 and 125, respectively. However, the gate lines may be divided into any number of blocks without departing from the scope of the present invention. In this case, blocks 123 and 125 have equal number of gate lines GL0 to GLk and GLk+1 to GLn, respectively, connected to the gate driver ICs 112*a* and 112*b* on the liquid crystal panel 102. Again, the blocks may be defined having different number of gate lines without departing from the scope of the present invention. Since the first and second blocks 123 and 125 each include a plurality of common voltage supply lines disposed in parallel to the corresponding plurality of gate lines, each of the blocks 123 and 125 can be defined identically by the plurality of common voltage supply lines.

The timing controller 116 is mounted on the data PCB 108 and generates a gate control signal and a data control signal. The gate control signal is supplied to the first gate TCP 110*a* through the data PCB 108, the first data TCP 104*a*, and the LOG-type signal line group 114*a*, and the data control signal is supplied to the first data TCP 104*a* through the data PCB 108.

The gate driver IC 112*a* mounted on the first gate TCP 10*a* is driven in response to the gate control signal to generate predetermined scan signals sequentially and to supply the scan signals to the plurality of gate lines GL1 to GLk connected to the gate driver IC 112*a*. After the scan signals are supplied to the plurality of gate lines GL1 to GLk connected to the gate driver IC 112*a*, the second gate driver IC 112*b* is driven to generate predetermined scan signals sequentially and to supply the scan signals to the plurality of gate lines GLk+1 to GLn connected to the second gate driver IC 112*b*. The gate line GL0 is a dummy gate line that is not supplied with the scan signal but supplied with a constant low level voltage.

The data control signals are supplied to the data driver ICs 106*a*, 106*b*, and 106*c* mounted on each of the data TCPs 104*a*, 104*b*, and 104*c*. Additionally, predetermined data signals are supplied to the data driver ICs 106*a*, 106*b*, and 106*c*. Accordingly, each of the data driver ICs 106*a*, 106*b*, and 106*c* supplies the data signals to the plurality of data lines DL1 to DLm in response to the data control signal.

First and second common voltage compensators 120*a* and 120*b* are mounted on the gate driver ICs 112*a* and 112*b*, respectively. That is, the first common voltage compensator 120*a* is mounted on the first gate driver IC 112*a* and the second common voltage compensator 120*b* is mounted on the second gate driver IC 112*b*. The first and second common voltage compensators 120*a* and 120*b* are each connected to the common voltage generator 118 to be supplied with a predetermined common voltage Vcom. With respect to the common voltage Vcom supplied from the common voltage generator 118, each of the common voltage compensators 120*a* and 120*b* compensates a distorted common voltage fed back from blocks 123 and 125 defined by the plurality of gate lines GL0 to GLk and GLk+1 to GLn connected to the gate driver ICs 112*a* and 112*b*, respectively. Each of the common voltage compensator 120*a* and 120*b* supplies a compensated common voltage to each of the blocks 123 and 125.

The common voltage compensators 120*a* and 120*b* are connected to the common voltage supply lines 113 disposed in parallel to the gate lines GL to GLn in the blocks 123 and 125, respectively. The input terminal of the common voltage compensators 120*a* and 120*b* are connected to the last common voltage supply line in the blocks 123 and 125, respectively, and the output terminal of the common voltage compensators 120*a* and 120*b* are connected to the first common voltage supply line in the blocks 123 and 125, respectively, thereby forming a feedback loop. Accordingly, the common voltage compensators 120*a* and 120*b* receive a distorted common voltage from the blocks 123 and 125, respectively. In response, each of the common voltage compensators 120*a* and 120*b* generates a compensated common voltage.

The compensated common voltage is generated by a phase inversion of the distortion common voltage determined from comparing the distorted common voltage with a predetermined common voltage supplied from the common voltage generator 118. Then, the common voltage compensators 120*a* and 120*b* supply the compensated common voltages to the blocks 123 and 125, respectively. Accordingly, the distorted common voltage is compensated by the respective compensated common voltages from the common voltage compensators 120*a* and 120*b*. Consequently, a normal common voltage can be maintained.

The compensated common voltages are reflected by the distorted common voltages separately generated in the blocks 123 and 125, respectively, and therefore may be different from each other. Accordingly, the optimized compensation common voltage can be supplied to each region separately. Consequently, a crosstalk phenomenon is prevented, and the image quality is improved.

For example, since a common voltage supplied to the liquid crystal panel 102 does not exist during a first frame, there is no distorted common voltage supplied to the first and second common voltage compensators 120*a* and 120*b*. The distorted common voltage is supplied to the first and the second common voltage compensators 120*a* and 120*b* before a second frame, because the distorted common voltage does exist after a first frame. Accordingly, a predetermined common voltage generated from the common voltage generator 118 is simultaneously supplied to the first and second blocks 123 and 125 of the liquid crystal panel 102 through the first and second common voltage compensators 120*a* and 120*b*.

As the common voltage is applied to the common voltage supply lines 13, distorted common voltages generated in the blocks 123 and 125, respectively, may be different from each other due to varying load characteristics, such as different sizes of the blocks 123 and 125 in the liquid crystal panel 2 and/or different line resistances in the common voltage supply lines 13. Accordingly, the distorted common voltages generated in the blocks 123 and 125 are fed back to the first and second common voltage compensators 120*a* and 120*b*, respectively.

Using the predetermined common voltage generated from the common voltage generator 118, the first common voltage compensator 120*a* generates a first compensated common voltage with an inverted phase with respect to the first distorted common voltage supplied from the first block 123 and supplies the first compensated common voltage to the first block 123. Similarly, using the predetermined common voltage generated from the common voltage generator 118, the second common voltage compensator 120*b* generates a second compensated common voltage with an inverted phase with respect to the second distorted common voltage supplied from the second block 125 and supplies the second compensation common voltage to the second block 125.

As described, the first distorted common voltage and the second distorted common voltage are fed back to the first common voltage compensator 120*a* and the second common voltage compensator 120*b*, respectively. The first and second distorted common voltages may have values that are different from each other. Accordingly, the first and second compensated common voltages outputted from the first and second common voltage compensators 120*a* and 120*b* may be different from each other. In particular, the first and second compensated common voltages respectively outputted from the first and second common voltage compensators 120*a* and 120*b* have a phase difference of 180° with respect to the corresponding distorted common voltages fed back from the blocks 123 and 125 to the first and second common voltage compensators 120*a* and 120*b*, respectively.

Since the first distorted common voltage in the first block 123 is compensated by the first compensated common voltage, the common voltage Vcom generated from the common voltage generator 118 is maintained. Additionally, since the second distorted common voltage in the second block 125 is compensated by the second compensated common voltage, the common voltage Vcom generated from the common voltage generator 118 is maintained. Accordingly, the common voltage Vcom generated from the common voltage generator 118 is maintained in the first and second blocks 123 and 125. Thus, there is no significant difference between common voltages in each region, thereby preventing a crosstalk phenomenon from occurring. Consequently, a more uniform image can be achieved.

Figure 3:
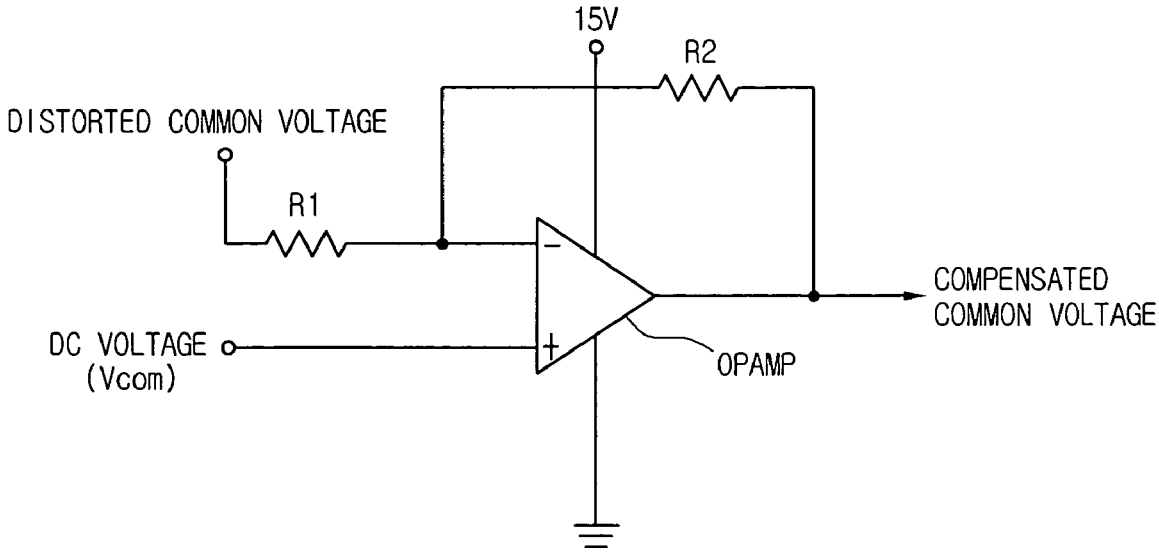
FIG. 3 is a circuit diagram of an exemplary common voltage compensator of FIG. 2.

As shown in FIG. 3, exemplary common voltage compensators 120*a* and 120*b* according to the present invention each include an operational amplifier (OPAMP) with first and second resistances R1 and R2. The OPAMP supplies a distorted common voltage fed back (from the block 123 or 125) to an inversion input terminal (−), and supplies a predetermined common voltage Vcom generated from the common voltage generator 118, namely, a DC voltage with a constant voltage level, to non-inversion input terminal (+).

The first and second common voltage compensators 120*a* and 120*b* may be built into the first and second gate driver ICs 112*a* and 112*b*, respectively. In the alternative, the common voltage compensators may be built into the data driver ICs 106*a*, 106*b*, and 106*c* to compensate for the distorted common voltage. Furthermore, the common voltage compensators may also be formed as separate units altogether without departing from the scope of the present invention.

When the common voltage compensator is built into each of the data driver ICs 106*a*, 106*b*, and 106*c*, the common voltage supply lines 113 may be disposed in parallel to the data lines instead of the gate lines. In this case, each block may be defined by a plurality of data lines connected to each of the data driver ICs 106*a*, 106*b*, and 106*c*. Accordingly, when each block is defined by a plurality of gate lines connected to each of the gate driver ICs 112*a* and 112*b*, each block is aligned in a vertical direction. However, when each block is defined by a plurality of data lines connected to each of the data driver ICs 106*a*, 106*b*, and 106*c*, each block is aligned in a horizontal direction.

As described above, a distortion of a common voltage is individually compensated for each section or block of the liquid crystal panel. Hence, a varying degree of distortion in each block of the liquid crystal panel is resolved individually, thereby preventing a crosstalk phenomenon from occurring. As a result, the image quality of the LCD is improved.

It will be apparent to those skilled in the art that various modifications and variations can be made in the LCD of the present invention and method of driving the same without departing form the spirit or scope of the invention. Thus, it is intended that the present invention cover the modifications and variations of this invention provided they come within the scope of the appended claims and their equivalents.

What is claimed is:

1. A liquid crystal display device (LCD), comprising:

a liquid crystal panel having a plurality of gate lines, a plurality of data lines, and a plurality of common voltage supply lines, wherein the liquid crystal panel is divided into a plurality of blocks, each having at least two common voltage supply lines;

a plurality of gate driver integrated circuits (ICs) connected to the plurality of gate lines;

a plurality of data driver ICs connected to the plurality of data lines;

a plurality of common voltage compensators configured to supply compensated common voltages to the common voltage supply lines of the corresponding blocks;

a common voltage generator connected to the common voltage compensators and configured to generate a predetermined common voltage directly supplied to the common voltage compensators, wherein each common voltage compensator includes an input terminal connected to one of the at least two common voltage supply lines and an output terminal connected to another of the at least two common voltage lines, and wherein each compensated common voltage has a phase opposite to that of a distorted common voltage from the one common voltage supply line with respect to the predetermined common voltage from the common voltage generator, and is supplied to the another common voltage supply line, wherein the input terminals of the common voltage compensator are respectively connected to both the common voltage generator and the last common voltage supply line of each block, the output terminal of the common voltage compensator is connected to the first common voltage supply line of each block, wherein the common voltage compensator generates the compensated common voltage as comparing the distorted common voltage supplied from the last common voltage supply line with a predetermined common voltage supplied from the common voltage generator, and then the common voltage compensator supplies the compensated common voltage to the first common voltage supply line of each block, wherein the common voltage compensator includes an operational amplifier, wherein the distorted common voltage is supplied to the inversion input terminal of the operational amplifier and the predetermined common voltage is supplied to the non- inversion input terminal of the operational amplifier, and then the compensated common voltage is generated from the output terminal of the operational amplifier, wherein each of the common voltage compensators is built into each of the corresponding gate driver ICs or data driver ICs, and wherein the distorted common voltage is supplied to each common voltage compensator through the last common voltage supply line of each block before the start of a second frame.

2. The LCD according to claim 1, wherein the compensated common voltages supplied by the plurality of common voltage compensators are different from each other.

3. The LCD according to claim 1, wherein each of the blocks is defined with respect to the gate lines.

4. The LCD according to claim 1, wherein each of the blocks is defined with respect to the data lines.

5. The LCD according to claim 1, wherein the number of blocks is equal to the number of gate driver ICs.

6. The LCD according to claim 1, wherein the number of blocks is equal to the number of data driver ICs.

7. The LCD according to claim 1, wherein each of the gate driver ICs is electrically connected to the corresponding plurality of gate lines and each of the data driver ICs is electrically connected to the corresponding plurality of data lines.

8. The LCD according to claim 1, wherein each of the common voltage compensators compensates a distorted common voltage generated in a corresponding one of the blocks with respect to a predetermined common voltage and supplies a corresponding one of the compensated common voltages to the corresponding block.

9. The LCD according to claim 1, wherein a phase difference between the distorted common voltage and the corresponding compensated common voltage is 180°.

10. The LCD according to claim 1, wherein each of the gate driver ICs is formed on a corresponding gate tape carrier package (TCP), and each of the data driver ICs is formed on a corresponding data TCP.

11. The LCD according to claim 1, wherein the number of gate lines in each block is different.

12. The LCD according to claim 1, wherein the number of data lines in each block is different.

* * * * *